United States Patent [19]

Rotzin

[11] Patent Number: 5,023,958

[45] Date of Patent: Jun. 18, 1991

[54] AERODYNAMIC BICYCLE HELMET

[76] Inventor: Stephen A. Rotzin, 32 Las Vegas Rd., Orinda, Calif. 94563

[21] Appl. No.: 402,605

[22] Filed: Sep. 1, 1989

[51] Int. Cl.[5] ..... A42B 3/00

[52] U.S. Cl. ..... 2/411; 2/414; 2/421; 2/425

[58] Field of Search ..... 2/410, 411, 412, 414, 2/425, 421

[56] References Cited

U.S. PATENT DOCUMENTS

| | | | |
|---|---|---|---|
| 4,006,496 | 2/1977 | Marker | 2/414 |
| 4,434,514 | 3/1984 | Sundahl et al. | 2/425 |
| 4,586,197 | 5/1986 | Hubbard | 2/410 |
| 4,622,700 | 11/1986 | Sundahl | 2/425 |
| 4,653,123 | 3/1987 | Broersma | 2/425 |

FOREIGN PATENT DOCUMENTS

| | | | |
|---|---|---|---|
| 96148 | 12/1983 | European Pat. Off. | 2/411 |
| 131929 | 1/1985 | European Pat. Off. | 2/410 |
| 217996 | 4/1987 | European Pat. Off. | 2/411 |
| 3305735 | 8/1984 | Fed. Rep. of Germany | 2/410 |
| 253759 | 2/1988 | Fed. Rep. of Germany | 2/411 |
| 8901744 | 3/1989 | PCT Int'l Appl. | 2/410 |

*Primary Examiner*—Werner H. Schroeder
*Assistant Examiner*—Michael A. Neas
*Attorney, Agent, or Firm*—Schroeder, Davis & Orliss

[57] ABSTRACT

A single piece, high impact resistant plastic foam helmet having a truncated teardrop shape for aerodynamic efficiency is provided. The helmet design incorporates three ridges centered across the upper front portion of the helmet causing airflow over the helmet to separate from the rear surface of the helmet prior to the onset of turbulence resulting in minimized buffeting of the helmet and reduced drag. A combination of buffeting and a unique retention strap adjustment clip result in greater stability of the helmet on a user's head.

10 Claims, 6 Drawing Sheets

AERODYNAMIC BICYCLE HELMET

BACKGROUND OF THE INVENTION

The present invention relates generally to an impact absorbing sport safety helmet for use in recreational activities and, more particularly, to a light weight safety helmet adapted for use by bicyclists having an improved aerodynamic design to reduce drag on the helmet and reduce buffeting of the helmet.

It is well known to provide shock and impact absorbing safety helmets for recreational use; for example, motorcyclists, bicyclists and football players and for professional use. Such safety helmets have ranged from simple cloth or leather head coverings with minimal padding to hard outer shells supported on a network of straps or webbing. Typically, a preferred design of protective helmets features a relatively hard outer helmet shell having flexible inner liners comprising either inflatable chambers or a foam material to support the helmet and dissipate forces applied thereto. See, for example, U S. Pat. No. 4,006,496 issued on Feb. 8, 1977 to Peter O. Marker. While the prior art helmet meets all present government and private safety standards and specifications, the bulk and weight of the helmet are typically too great to be adaptable for such sports as bicycling or running. Typically, prior art bicycle helmets are hot, heavy, cumbersome and unattractive and cyclists resisted wearing such helmets because they impaired performance.

More recently improved helmets for both the professional and amateur cyclist have been developed and marketed. The newer helmets comprise a foam-only helmet fabricated from an expanded polystyrene plastic foam that absorbs shock on impact by crushing or fracturing. Elimination of the hard shell provides a helmet having less bulk and less weight. Further, the newer helmets are aerodynamically designed and include air vents in the front and rear of the helmets to create a flow-through ventilation system. While the newer helmets meet and exceed all of the safety standards and specifications promulgated by private organizations, they are more susceptible to everyday abuse, such as throwing in the trunk of a car or dropping on the floor which may diminish its shock absorbing capacity. Further, at higher speeds, such as those encountered by professional racing cyclists, airflow turbulence tends to develop at the rear of the helmet causing buffeting of the helmet at the back of the neck. This buffeting action tends to dislodge and push or cause the helmet to slide forward on a bicyclist's head.

SUMMARY OF THE INVENTION

A bicycle helmet constructed in accordance with the principles of the present invention comprises a foam-only body having an improved aerodynamic shape and includes a flow-through ventilation system. The single piece helmet body has a truncated teardrop shape with three ridges or ripples molded in the surface centered on the top front of the helmet. The placement of the ridges on the front half of the helmet surface improves the aerodynamic efficiency of the helmet body. The airflow over the helmet is lifted by the ridges and caused to separate from the helmet rear surface while the airflow is still laminar rather than remaining attached to the helmet surface until the onset of turbulence at the rear of the helmet. The flow-through ventilation system comprises two front air vents and four large air vents on the rear surface of the helmet to create a ventilation system which pulls the air through the helmet and improves the aerodynamic efficiency by filling in at the rear of the helmet. The separation of the laminar air flow from the rear surface of the helmet prior to the onset of turbulence reduces the drag on the helmet and minimizes helmet buffeting.

The bicycling helmet of the present invention utilizes a tubular nylon chin strap comprising front and back flush-mounted webbed strapping joined at a novel multichannel strap adjuster. The multistrap adjuster provides for adjustment of the front and back strap without binding or catching. Further, the multistrap adjuster allows the strap to be adjusted one time for a particular user without necessitating readjustment each time the helmet is put on. The flush-mounted design insures user comfort, a good fit and aerodynamic performance.

The present invention provides an improved lightweight cycling helmet that may be readily constructed from commercially available materials and meets all present and contemplated safety standards and specifications. The helmet's teardrop design includes a shaped skirting or flange extending from the lower edges of the helmet to provide protection to vital areas of the head and neck. The helmet is constructed of preferred materials which are more impact resistant than the expanded polystyrene plastic foam utilized in prior art helmets.

DETAILED DESCRIPTION OF THE PREFERRED EMBODIMENT

Figure 5A:
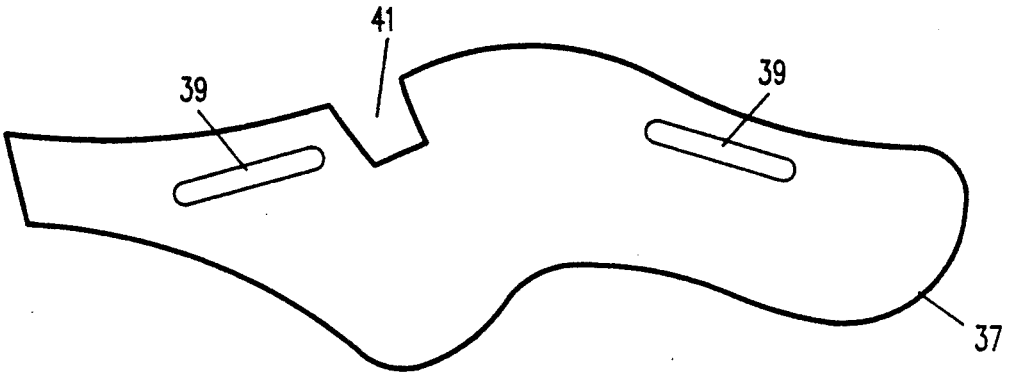
FIG. 5*a* is a plan view of an internal foam spacing pad for use with the bicycle helmet shown in FIG. 1.
Figure 5B:
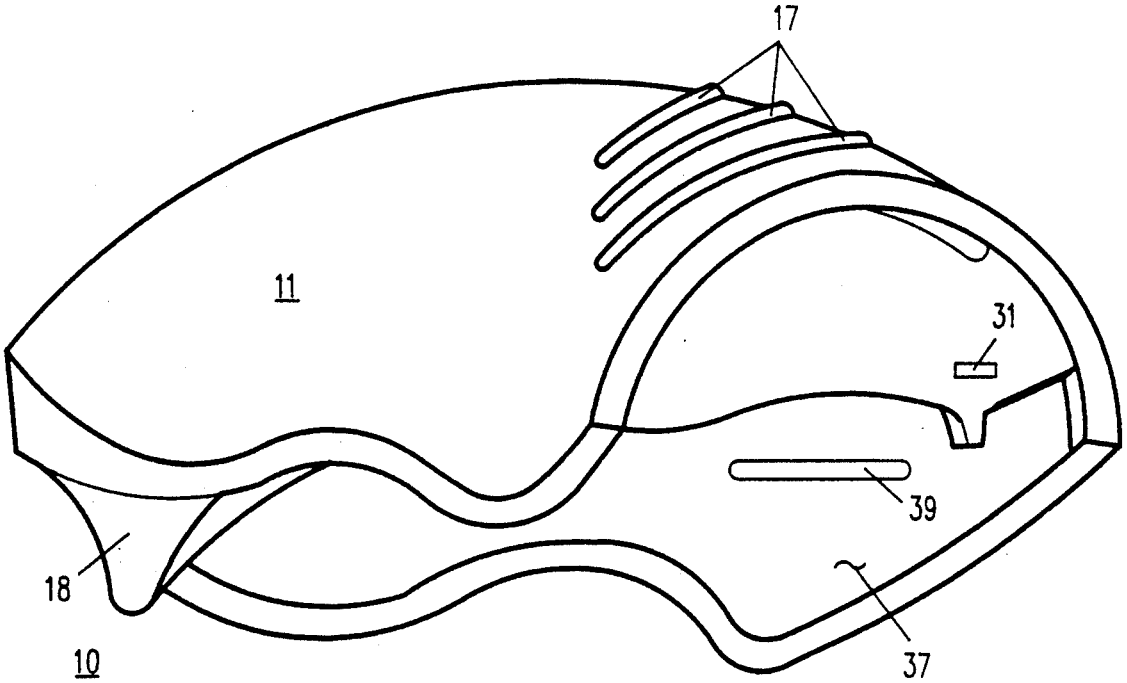
FIG. 5*b* is a cutaway perspective view illustrating the internal foam pad of FIG. 5*a* installed in the bicycle helmet of the present invention.

Referring now to FIGS. 1 through 4, a bicycle helmet constructed in accordance with the principles of the present invention is shown. The helmet 10 comprises a single piece foam-only body 11 having a truncated teardrop shape defining a hemispherical concave cap designed to fit on the head of a user. Internal foam liners 37 (as shown in FIGS. 5*a* and 5*b*) are provided in a number of sizes to allow a single helmet body 11 to fit a large range of head sizes. A shaped skirt or flange 13 extends from the peripheral of the body 11 to provide protection for vital areas of the head such as the temple area. A second shaped flange 18 extends downwardly at the back of the body 11 to provide protection for the back of the neck where it joins a user's head.

A flow-through ventilation system comprises two front air vents 12 and four back air vents 14 and 16. To provide maximum cooling effect and insure aerodynamic efficiency, the air vents 12, 14, and 16 are smoothly contoured and formed in recessed troughs 15 which run the length of the helmet body 11. The troughs and front vents are aligned with the rear vents to allow the air to follow the path of least resistance and exit the helmet quickly.

Figure 1:
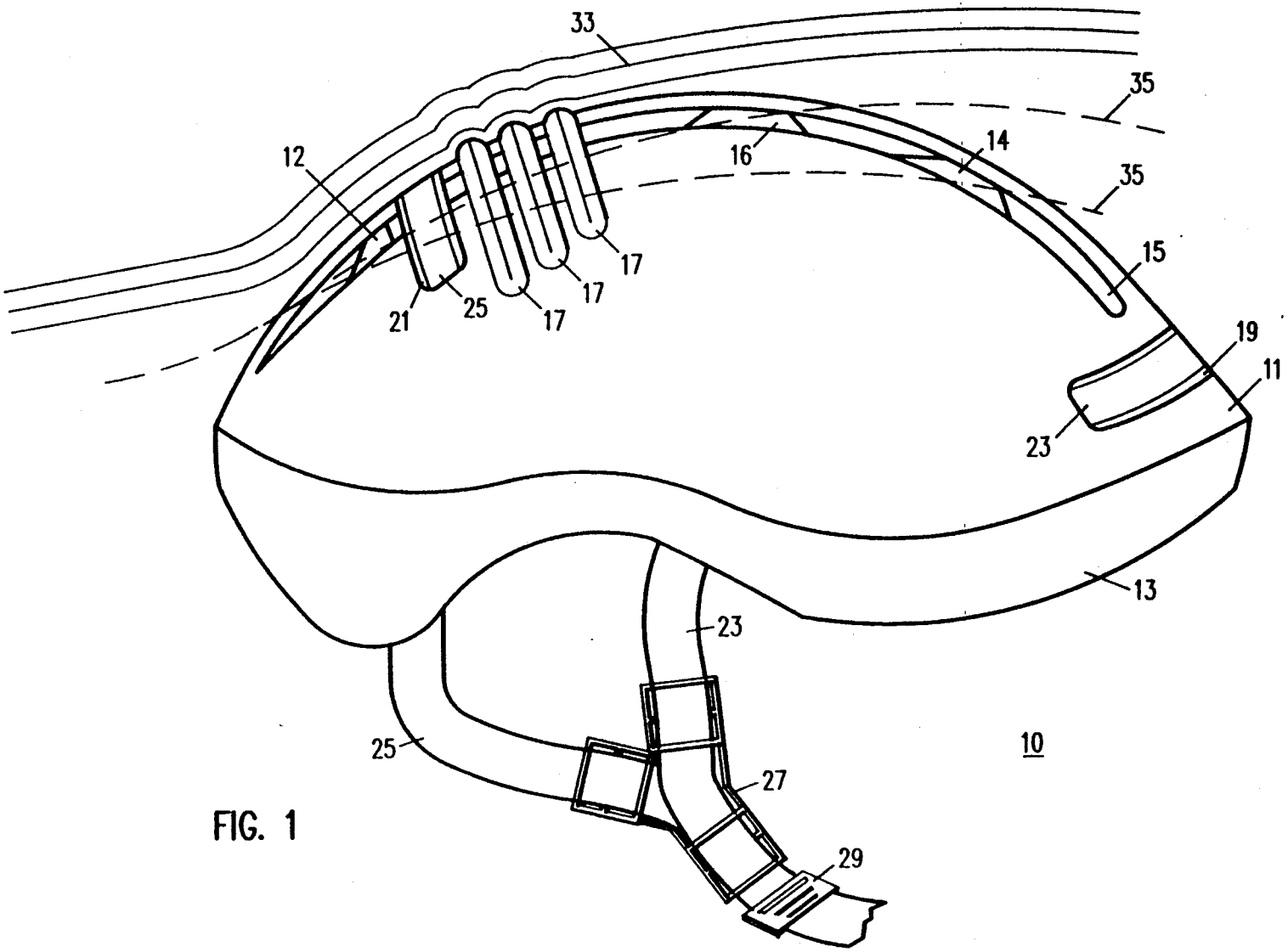
FIG. 1 is a side view in perspective of a bicycle helmet constructed in accordance with the principles of the present invention.
Figure 2:
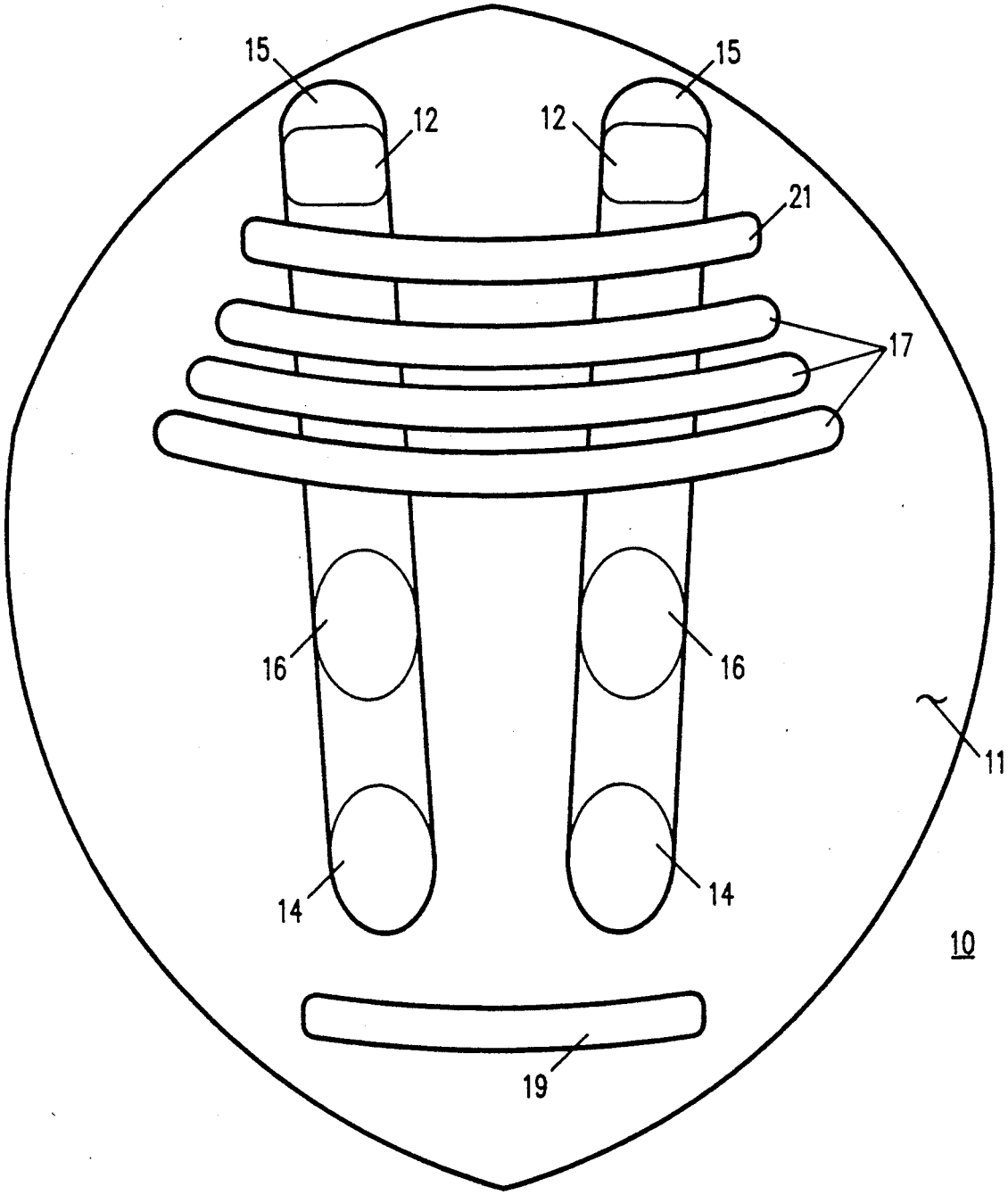
FIG. 2 is a top view of the bicycle helmet shown in FIG. 1.
Figure 3:
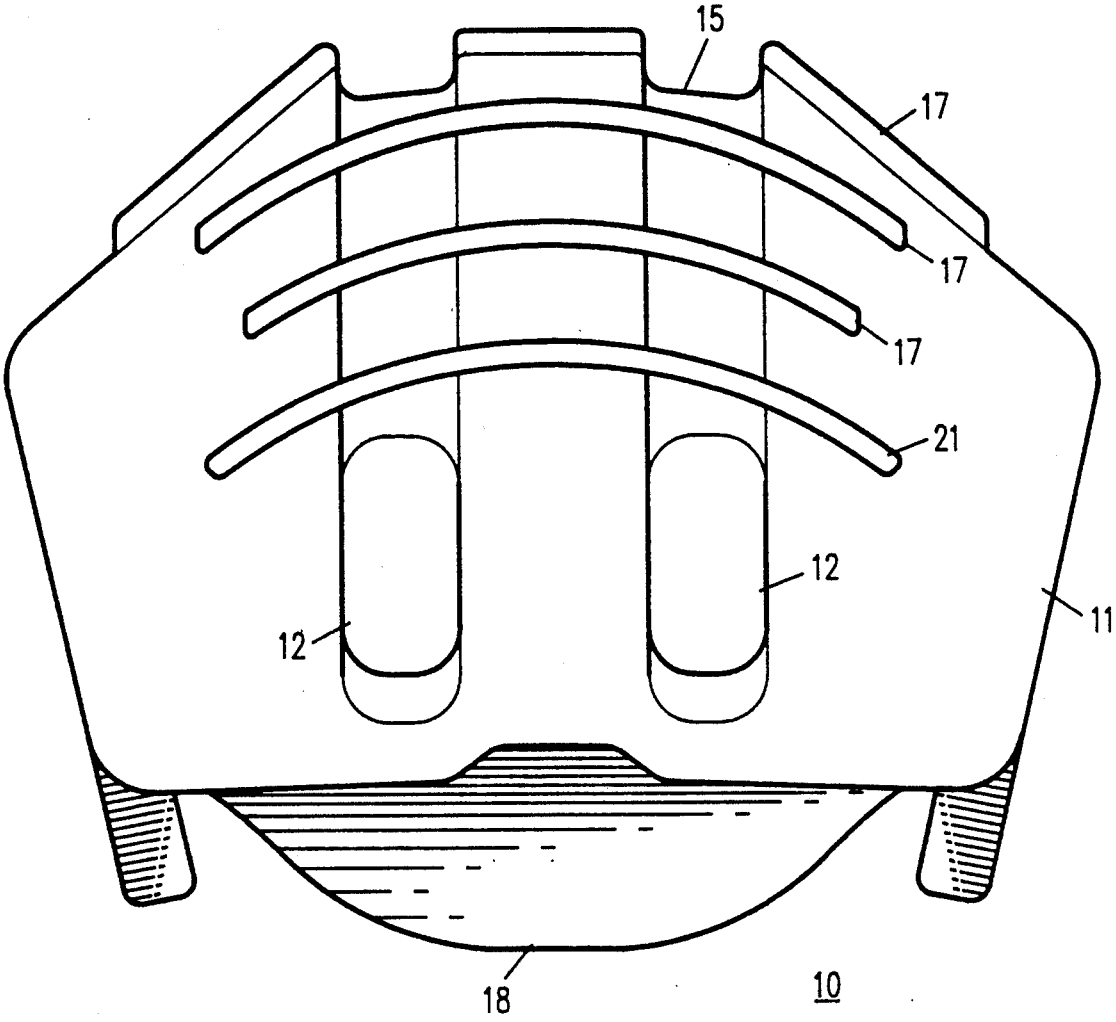
FIG. 3 is a front view of the bicycle helmet shown in FIG. 1.
Figure 4:
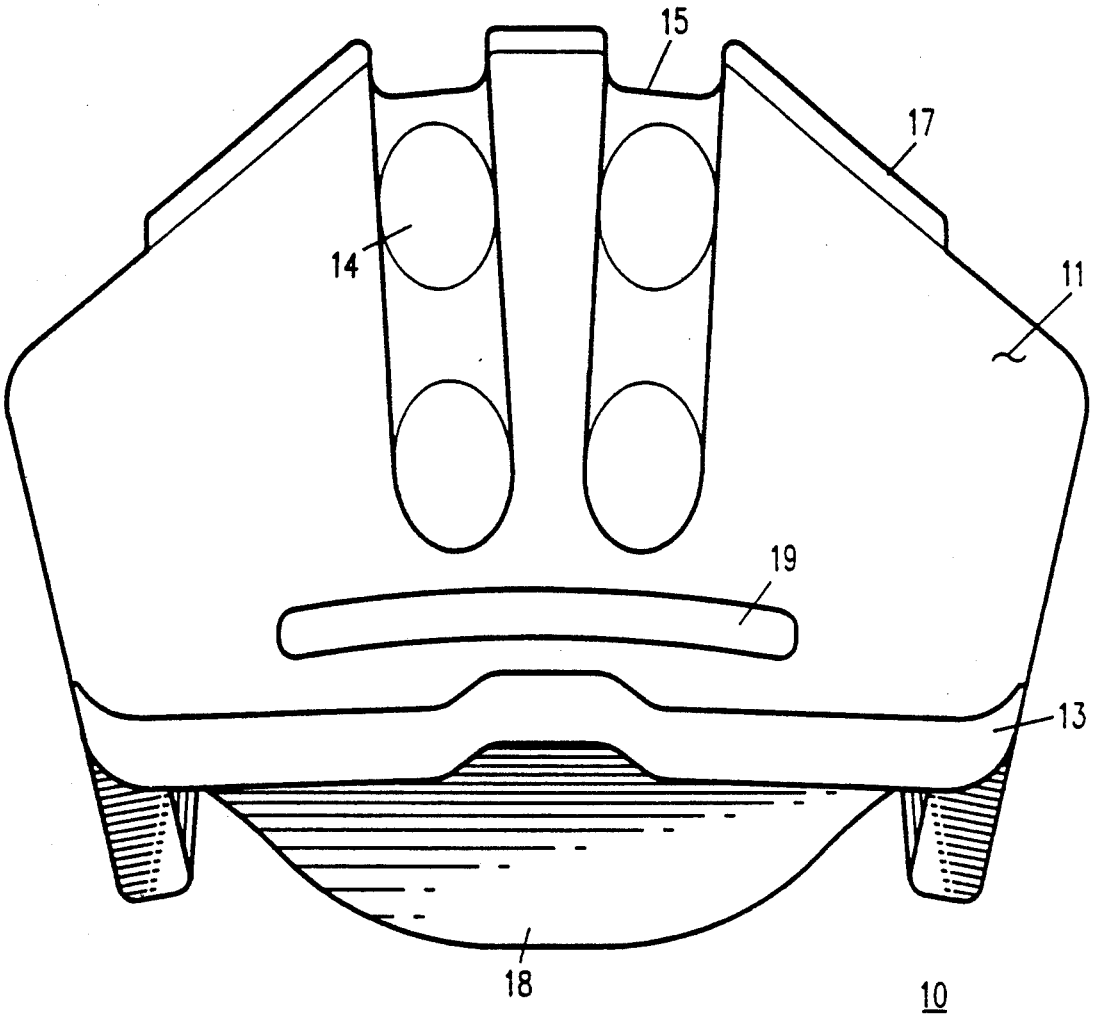
FIG. 4 is a back view of the bicycle helmet shown in FIG. 1.

The helmet chin strap comprises rear strap 23 and front strap 25 at a multichannel strap adjuster 27. The front strap 25 is routed under flange 13 along the inside surface (not shown) of the helmet body 11 through a strap hole 31 (as shown in FIG. 5*b*) and across, the front of, the helmet on the outside surface of the body 11 (as shown in FIG. 1). The front strap 25 may be placed on top of the helmet body 11 or may be mounted flush with the surface of body 11 in recess 21. The front strap 25 is then routed through a second strap hole in the helmet body 11 and along the inner surface of the helmet to exit from under flange 13 at the opposite side of the helmet. Similarly, the rear strap 23 is routed along the inside of the helmet through the body 11 over the rear exterior surface of the helmet in recess 19 (as shown in FIG. 1) and back through the body 11 and out the opposite side. Both the front strap 25 and rear strap 23 are threaded through a multichannel strap adjuster clip 27 and into a buckle 29. Buckle 29 may be any conventional buckle commercially available (a buckle known as FASTEX and manufactured by ITW Nexus is suitable for this purpose).

The helmet body 11 includes 3 ridges or ripples 17 across the top of the front portion of the helmet. For greater aerodynamic efficiency and minimum drag it is desireable to delay the onset of turbulence in the airstream for as long as possible. In addition to increasing drag, turbulence at the rear of the helmet causes buffeting of the helmet and tends to cause the helmet to slide up and forward on a user's head. As illustrated by curved lines 33, the ridges 17 lift the airflow and cause separation of the airflow from the rear surface of the helmet body 11 prior to the onset of turbulence while the airflow is still laminar. Airflow through the two front air vents 12 and the four rear air vents 14, 16 as indicated by dashed lines 35 improves the aerodynamic efficiency by filling in at the rear of the helmet. Separation of the airflow from the rear surface of the helmet body 11 reduces the drag on the helmet and minimizes helmet buffeting and lift at higher speeds.

Referring now also the to FIGS. 5*a* and 5*b*, shaped, resilient internal foam spacers are inserted in the interior of the helmet to provide a custom fit for an individual user's head. Cutouts 39 in each internal foam spacer 37 allow for compression and expansion of the foam spacer 37 when the helmet is fitted. Each spacer 37 includes notch 41 to allow proper routing of the front strap 25. To provide a wide range of sizes for a single size helmet body 11, the internal foam spacers 37 are provided in several thicknesses; for example, $\frac{1}{4}$ inch, $\frac{3}{8}$ inch, and $\frac{1}{2}$ inch. The internal foam spacers 37 are backed with an adhesive to allow attachment to the interior surface of the helmet body 11.

The helmet body 11 is fabricated as a single piece by injection molding or other suitable method. The preferred embodiment utilizes a two-piece injection mold in a self-contained steam chest. The helmet body 11 is approximately 12 inches long, $6\frac{1}{4}$ inches high and 9 inches wide. The ridges 17 are molded integrally with the helmet body 11 and are placed on the top front portion of the helmet. The first ridge is placed approximately $4\frac{3}{4}$ inches up from the leading edge of the helmet body 11 followed by two more ridges 17 separated by approximately $\frac{3}{8}$ inch, respectively. The leading ridge is approximately 10 inches long and centered on the exterior of the helmet body 11. The second ridge is approximately 9 inches long centered $\frac{3}{8}$ inch behind the leading ridge. The third ridge is 8 inches long and is centered approximately $\frac{3}{8}$ inch behind the second ridge. Each ridge is approximately $\frac{1}{4}$ inch wide. While the number, placement and size of the ridges 17 may vary, the ridges as described herein have been found to provide optimal aerodynamic characteristics.

The helmet body 11 is fabricated from an impact resistant, multicelled resilient foam such as polypropylene plastic foam. (A polyproplene plastic foam having a density of 3.8 to 4.2 pounds per cubic foot manufactured by Arco Polymer, Inc. is suitable for this purpose.) The helmet body 11 ranges in thickness from $\frac{7}{8}$ inch to $1\frac{1}{8}$ inch. The internal foam spacer 37 is fabricated from a more resilient, multicelled foam material such as a polyurethane foam (CONFOR C-40 foam manufactured by Specialty Composites, Inc. is suitable for this purpose) and is dye-stamped and adhesive backed.

Figure 6A:
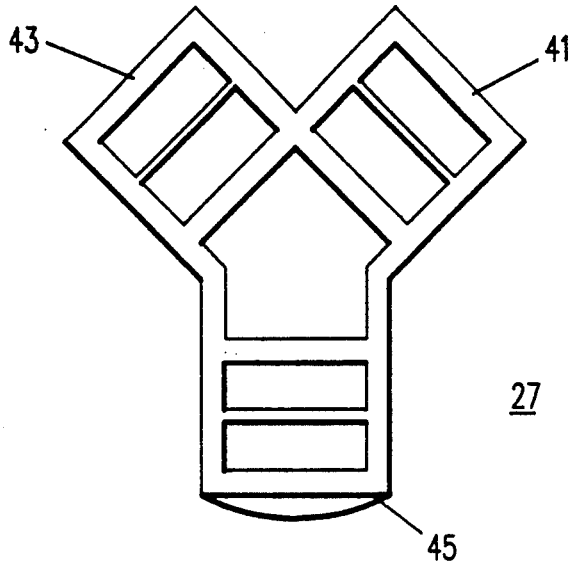
FIGS. 6*a* and 6*b* are plan views illustrating the multichannel strap adjustment clip of the present invention.
Figure 6B:
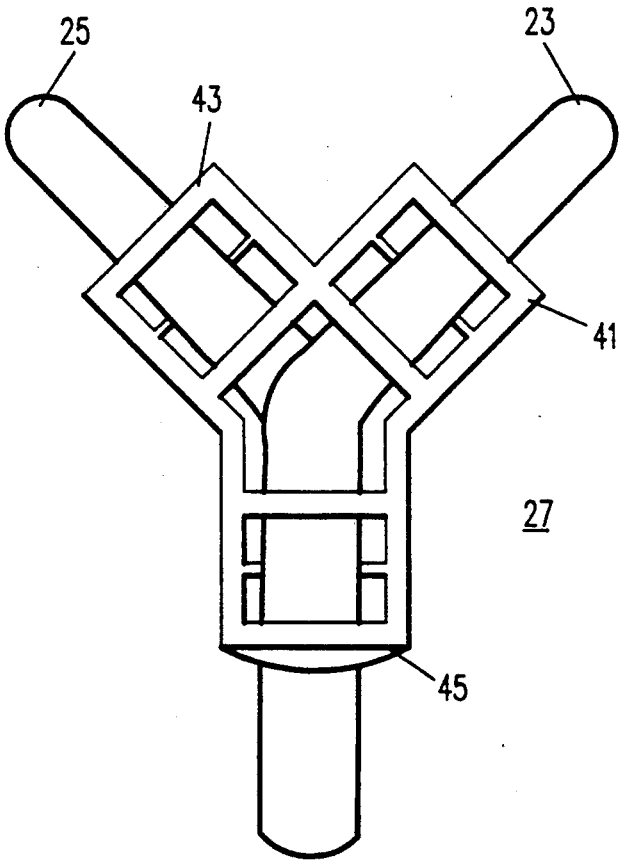

Referring now also to FIG. 6*a* and 6*b*, a multichanneled strap adjuster according to the principles of the present invention is shown. The multichannel strap adjuster 27 comprises a Y-shaped clip having two inlet channels 41 and 43 and one outlet channel 45. A first strap, front strap 25 for example, is threaded through inlet channel 43 and out the outlet channel 45. Similarly a second strap, rear strap 23 for example, is then threaded through inlet channel 41 and out the outlet channel 45. The multichannel strap adjuster allows both the front and rear straps 25, 23 to be adjusted simultaneously to provide a proper and snug fit without binding or catching of the straps. The multichannel strap adjuster 27 has an overall length of approximately 2 inches with a channel width of $\frac{3}{4}$ of an inch and will accommodate straps up to $\frac{5}{8}$ of an inch in width. The multichannel strap adjuster 27 may be fabricated from plastic such as acetal plastic or other suitable material.

While the details of the helmet described hereinabove have particular application to bicycle helmets, it is by no means limited thereto and helmets and other protective headgear incorporating the claimed design may be advantageously used in other activities. It will be apparent to those skilled in the art that the other changes and modifications may be made in the present invention without departing from the spirit and the scope of the invention as set forth in the appended claims.

I claim:

1. A bicycle safety helmet comprising a concave body internally shaped to conform to and be worn on a user's head and having stabilizing means for stabilizing said helmet on the user's head, said stabilizing means comprising:

at least one ridge transversely disposed on a forward portion of the external surface of said helmet body;

ventilation means including at least one front aperture formed in a forward portion of said helmet body and at least one rear aperture formed in a rear portion of said helmet body, said ventilation means providing an airflow through said helmet body, the airflow entering the helmet body through said front aperture and exiting the helmet body through said rear aperture and flowing over said rear portion of said helmet body;

helmet retention straps including a forward strap and a rear strap, said forward and rear straps being routed through apertures formed in said helmet body and over the external surfaces of a forward portion of said helmet body and said rear portion, respectively, said retention straps coupled together in a buckle means under the chin of a user; and strap adjustment means for adjusting said helmet retention straps.

2. A bicycle safety helmet as in claim 1 wherein said helmet retention straps are disposed in a forward recess and a rear recess, respectively, formed in the external surface of said body, said helmet retention straps being flush with said exterior surface.

3. A bicycle safety helmet comprising a concave body internally shaped to conform to and be worn on a user'head and having stabilizing means for stabilizing said helmet on the user's head, said stabilizing means comprising:

at least one ridge transversely disposed on a forward portion of the external surface of said helmet body;

ventilation means including at least one front aperture formed in a forward portion of said helmet body and at least one rear aperture formed in a rear portion of said helmet body, said ventilation means providing an airflow through said helmet body, the airflow entering the helmet body through said front aperture and exiting the helmet body through said rear aperture and flowing over said rear portion of said helmet body; and at least one recess formed in the external surface of said helmet body, said recess extending the length of said helmet body from said forward portion to said rear portion, said apertures disposed in said recess.

4. A bicycle safety helmet as in claim 3 wherein said helmet body has an aerodynamic teardrop shape.

5. A bicycle safety helmet as in claim 3 wherein said stabilizing means comprises three ridges in spaced apart relationship formed on the external surface of a forward portion of said body, said ridges centered near the top of said body, the airflow over said ridges being lifted and separated from the surface of said rear portion of said body.

6. A bicycle safety helmet as in claim 3 wherein said stabilizing means further includes strap adjustment means for adjusting helmet retention straps for stabilizing said body on the user's head.

7. A bicycle safety helmet as in claim 6 wherein said strap adjustment means comprises a multichannel strap adjuster.

8. A bicycle safety helmet as in claim 7 wherein said multichannel strap adjuster comprises a Y-shaped clip defining a pair of inlet channels and a single outlet channel, each inlet channel receiving and frictionally engaging a different helmet retention strap, said helmet retention straps threaded through said inlet channels to and through said outlet channel.

9. A bicycle safety helmet as in claim 6 wherein said helmet retention straps comprise a forward strap and a rear strap, said forward and rear straps being routed through apertures formed in said helmet body and over the external surface of a forward portion of said helmet body and said rear portion, respectively, said helmet retention straps coupled together in a buckle means under the chin of a user.

10. A bicycle safety helmet as in claim 9 wherein said helmet retention straps are disposed in a forward recess and a rear recess, respectively, formed in the external surface of said body, said helmet retention straps being flush with said exterior surface.

* * * * *